United States Patent [19]

Koumura et al.

[11] 4,335,912

[45] Jun. 22, 1982

[54] DOOR LOCKING APPARATUS

[75] Inventors: Masahiko Koumura, Konan; Hiroshi Mizuno, Iwakura, both of Japan

[73] Assignee: Rinnai Kabushiki Kaisha, Fukuzumi, Japan

[21] Appl. No.: 121,282

[22] Filed: Feb. 13, 1980

[30] Foreign Application Priority Data

Feb. 16, 1979 [JP] Japan ..... 54-17740[U]

[51] Int. Cl.[3] ..... E05C 1/12

[52] U.S. Cl. ..... 292/336.3; 292/168; 292/166; 292/DIG. 30

[58] Field of Search ..... 292/336.3, 166, 168, 292/174, 21, DIG. 69, DIG. 30

[56] References Cited

U.S. PATENT DOCUMENTS 3,024,053 3/1962 Cox ..... 292/21

4,113,292 9/1978 Gauron ..... 292/336.3

4,257,647 3/1981 Gianessi ..... 292/166

*Primary Examiner*—Robert L. Wolfe

*Attorney, Agent, or Firm*—Leonard Bloom

[57] ABSTRACT

A door locking apparatus has a grip bar mounted on the main handle for operating a door locking bolt. The grip bar is movable forward and rearward. A pair of links are located within the handle, facing the grip bar and forming therewith an isoceles triangle, the base of which is the grip bar. The intermediate portion of each link is pivotally attached to the handle. These links are interconnected to each other at their forward end portions, and are connected at their base end portions to the grip bar, for relative movement therebetween. Consequently, the grip bar can be given a parallel motion even when the same is gripped at any portion.

8 Claims, 9 Drawing Figures

DOOR LOCKING APPARATUS

BACKGROUND OF THE INVENTION

The present invention relates to door locking apparatus used chiefly for a cooking device such as magnetron range or the like.

As for an apparatus of this kind, there has been hitherto known such a type one that a grip bar for operating a door locking bolt is so provided on a handle main body as to be movable forward and backward along in a line making a right angle with the longitudinal direction of the handle main body. It is desirable in this case that, even when the grip rod is gripped at any desired portion, the grip bar can be given a parallel motion, for securing a reliable operation of the door locking bolt.

As far as an apparatus of this kind meeting this requirement is concerned, there has been hitherto known such a type one that, as shown in FIG. 1, for instance, an X-shaped parallel ruler type mechanism comprising a pair of links c, c crossed one another in the shape of X is interposed between a handle main body a and a grip bar b, and a bell crank lever d connected to a locking bolt is connected thereto. This type one, however, is inconvenient in that the same requires increased material costs because the length of each of the links c, c has to be prepared to become nearly equal to that of the grip bar b.

SUMMARY OF THE INVENTION

The object of the present invention is to provide apparatus which is free from the foregoing inconvenience, and in which a grip bar for operating a door locking bolt is so provided on a handle main body provided on a door as to be movable forward and backward along a line making a right angle with the longitudinal direction in which the handle main body is disposed. To accomplish this feature a pair of links are disposed as to lie oppositely of the forward moving direction of the grip bar. These links, together with the grip bar, form an isosceles triangle, the base of which is the grip bar. The link are pivotally attached individually at their middle portions, through pivotal supporting points to the handle main body, and the links also are interconnected at the apex of the triangle, that is, the intersection of the forward end portions, of the respective links. With this structural arrangement, on turning of one of the two links the other thereof may be turned in accordance therewith; and each of the links is connected to the grip bar so that, on turning thereof, the grip rod may be moved in accordance therewith in the foregoing forward moving direction.

The novel features which are considered as characteristic for the invention are set forth in particular in the appended claims. The invention itself, however, both as to its construction and its method of operation together with additional objects and advantages thereof, will be best understood from the following description of specific embodiments when read in connection with the accompanying drawings.

DESCRIPTION OF THE PREFERRED EMBODIMENTS

The present invention relates to a door locking apparatus used chiefly for a cooking device such as a magnetron range or the like.

As for an apparatus of this kind, there has been hitherto known such a type one that a grip bar for operating a door locking bolt is so provided on a handle main body as to be movable forward and rearward along in a line making a right angle with the longitudinal direction of the handle main body. It is desirable in this case that, even when the grip rod is gripped at any desired portion, the grip bar can be given a parallel motion, for securing a reliable operation of the door locking bolt.

Figure 1:
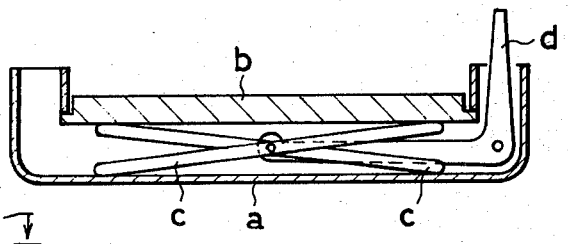
FIG. 1 is an explanation diagram of a conventional apparatus.
Figure 2:
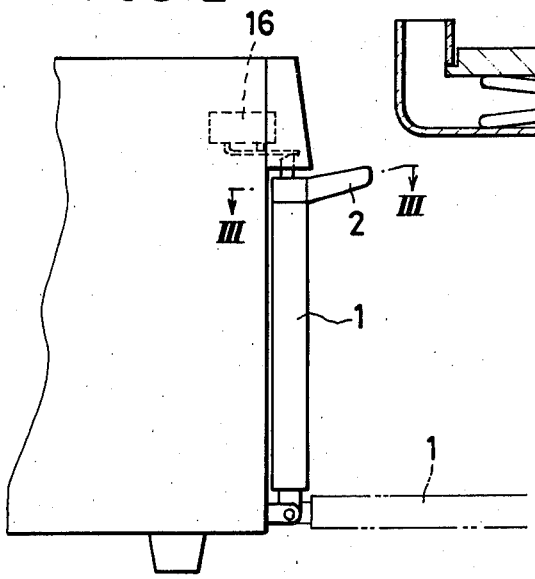
FIG. 2 is a side view of a cooking device having one example of this invention apparatus.

As far as an apparatus of this kind meeting this requirement is concerned, there has been hitherto known such a type one that, as shown in FIG. 1, for instance, an X-shaped parallel ruler type mechanism comprising a pair of links c, c crossed one another in the shape of X is interposed between a handle main body a and a grip bar b, and a bell crank lever d connected to a locking bolt is connected thereto. This type one, however, is inconvenient in that the same requires increased material costs because the length of each of the links c, c has to be prepared to become nearly equal to that of the grip bar b.

This invention has for its object to provide an apparatus free from this inconvenience, and in an apparatus of the type that a grip bar 4 for operating a door locking bolt 3 is so provided on a handle main body 2 provided on a door 1 as to be movable forward and backward along a line making a right angle with the longitudinal direction of the handle main body 2. The apparatus is characterized in that a pair of links 5, 5, which are so disposed as to lie oppositely of the forward moving direction of the grip bar 4. Together with the grip bar, these links form an isosceles triangle, the base of which is the grip bar 4. The links, are pivotally attached individually at their middle portions through pivotal supporting points 6, 6 to the handle main body 2; and the links also are interconnected at the apex, that is, the intersection of their forward end portions. As a result, on turning of one of the two links 5, 5, the other thereof may be turned in accordance therewith; and each of the links 5, 5 is connected to the grip bar 4 so that, on turning thereof, the grip rod 4 may be moved in accordance therewith in the foregoing forward moving direction.

One embodying example of this invention is shown in FIGS. 2 to 7. As shown clearly in FIG. 2, for instance, the door 1 is attached to the front surface of a cooking device A so as to be turned opened with its inner surface directing upwards, and also the same is provided on the upper side portion of the front surface thereof with the handle main body 2 and is further provided on the right and left sides of the top surface thereof with a pair of locking bolts 3, 3 which are so arranged as to project and retreat. As shown clearly in FIGS. 3 and 4, for instance, the grip bar 4 which extends long in the right and left directions is so provided on the back side of a longitudinal portion of the handle main body 2 as to be movable in the forward and backward directions, and return springs 9, 9 are connected to arm members 4*a*, 4*a* provided on the right and left end portions of the grip bar 4 so that if the grip bar 4 is gripped, the grip bar 4 is pushed to move forwards against the action of the return springs 9, 9, and thereby the locking bolts 3, 3 are given their respective movements to their retreated positions for unlocking the door 1. The pair of links 5, 5, each of which is approximately half, in length, the grip bar 4, are pivotally supported individually at their middle portions through pivotal supporting points 6, 6 on respective brackets 2*a*, 2*a* provided on the handle main body 2, and are interconnected at the apex of the isosceles triangle, that is the intersection of their formal end portions through a pin 10 provided on one side link and a slot 11 made in the other side link. The interconnection between the two links 5, 5 is not limited to this, and may be so modified, for instance, that, as shown in FIG. 8, the two links 5, 5 are meshed one another at respective segment gears 10*a*, 11*a* formed on their forward ends, so that when one of the links 5, 5 is turned, the other thereof may be turned in accordance therewith.

Figure 9:
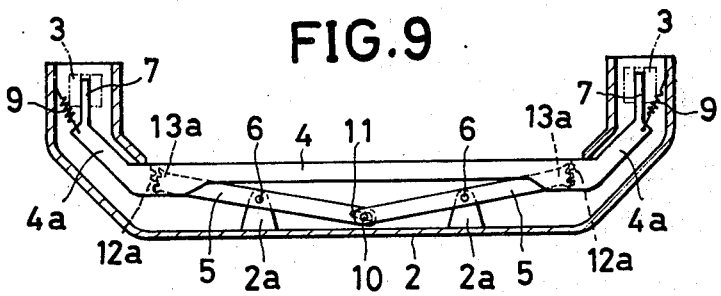

Each of the links 5, 5 and the grip bar 4 are interconnected through a pin 12 provided on each lateral end portion of the grip bar 4 and a slot 13 made in the base end portion of the link 5, but the connection is not limited to this and may be so modified that, as shown in FIG. 9, for instance, the grip bar 4 is formed with a rack 12*a* and the link 5 is formed with a segment gear 12*b* which is meshed therewith, so that as the link 5 is turned, the grip rod 4 may be moved forward in accordance therewith.

Additionally, in the illustrated embodiment, the outer end of each of the right and left arm members 4*a*, 4*a* formed on the opposite ends of the grip bar 4 is provided with a cam 7, and each of the locking bolts 3, 3 is provided with a cam follower 8 which is in pressure contact with the cam 7, so that the forward and backward movements of the grip bar 4 may be converted into retreating and projecting movements of the locking bolt 3 through the cam 7 and the cam follower 8, without using a complicated mechanism such as a bell crank lever or the like.

More in detail, the locking bolt 3 is urged upwards to be at its projecting position by a spring 14 provided on its bottom end side, and the cam 7 of which the lower side surface is formed into a cam edge 7*a* inclined downwards is inserted in a slit 15 made in the middle portion of the locking bolt 3, and the cam 7 is supported within the slit 15 by the cam follower 8 so as to be in pressure contact therewith, and consequently when the cam 7 is moved forwards, the locking bolt 3 is pushed by the cam edge 7*a* to move to its lower retreated position against the action of the spring 14.

Referring to the drawings numeral 16 denotes a key switch which is so arranged that the same is opened by the movement of the locking bolt 3 to its retreated position for suspending the operation of a heat source such as a magnetron or the like.

Figure 3:
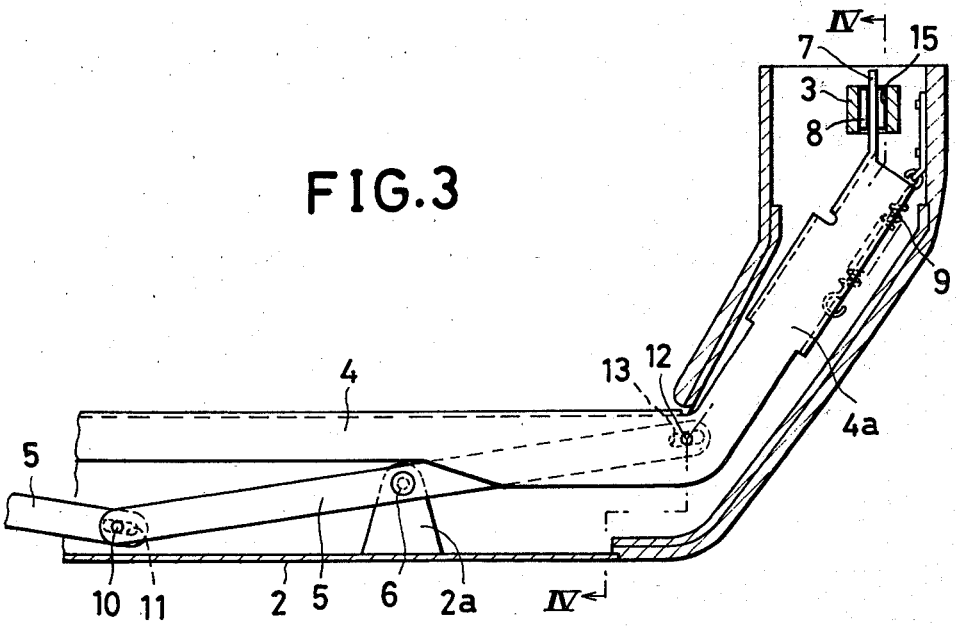
FIG. 3 is an enlarged sectional view of a part thereof taken along the line III—III in FIG. 2.
Figure 4:
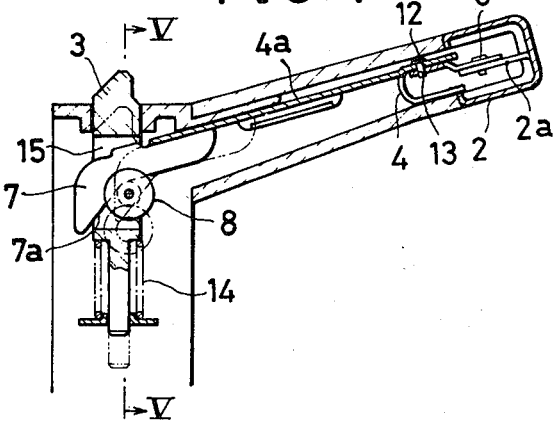
FIG. 4 is a sectional view taken along the line IV—IV in FIG. 3.
Figure 5:
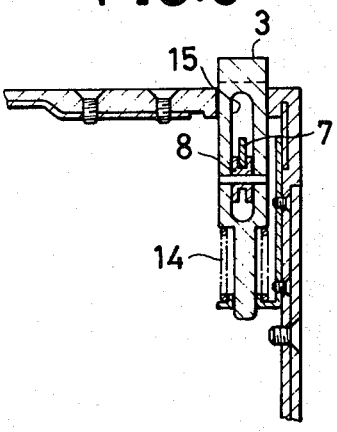
FIG. 5 is a sectional view taken along the line V—V in FIG. 5.
Figure 6:
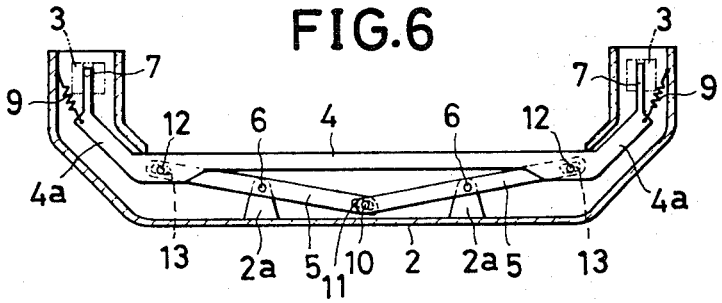
FIGS. 6 and 7 are diagrams for explaining the operation of a grip bar.
Figure 7:
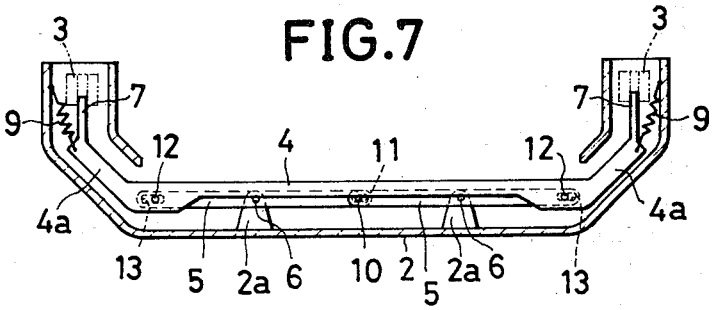
Figure 8:
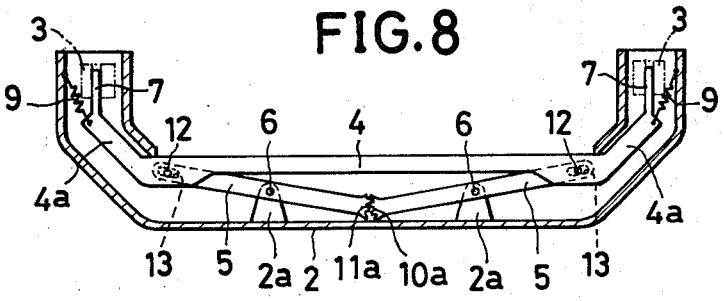
FIGS. 8 and 9 are sectional plan views showing modified examples of connecting portions thereof.

Next, the operation of the apparatus will be explained as follows:

In such a case that, under the condition shown in FIG. 3 and FIG. 6, one end portion, for instance, of the grip bar 4 is gripped, the link 5 on the corresponding one side is pushed thereby to turn about the pivotal supporting point 6, and in accordance therewith the link 5 on the other side connected thereto at the apex intersection of their forward end portions is also turned, and thereby the other end portion of the grip bar 4, that is, connected to the base end thereof is given a forward movement which is equal in amount to that of that one end portion, and as a result the whole, that is, all the parts of the grip rod 4 can be given a forward parallel motion as clearly shown in FIG. 7. Consequently, the cams 7, 7 on the opposite ends thereof can be moved equally and the right and left locking bolts 3, 3 are both moved to their retreated positions, and thereby unlocking of the door can be achieved without fail.

When released from the gripping operation, the grip bar 4 is moved back to its original position by the return springs 9, 9, and both cams 7 are returned backwards and thereby the locking bolts 3 are given their movements to the projecting positions by the springs 14.

Thus, according to this invention, the grip bar 4 is so arranged as to be given a parallel motion reliably regardless of the gripped position thereof by such an arrangement that an isosceles triangle is formed by the same together with the pair of links 5, 5, so that there can be given a reliable feeling in operation thereof and a reliable operation of the door locking mechanism can be achieved, and also the apparatus is advantageous also in material costs because the length of the link 5 may be shortened to approximately a half that of the conventional one used in the X-shape parallel ruler type mechanism.

What is claimed is:

1. A door locking apparatus, comprising, in combination, a door having a main handle, at least one locking bolt carried by the handle for retaining the door in a latched position, a grip bar for operating the locking bolt, means mounting the grip bar on the handle for forward and rearward movement in a direction substantially at right angles to the handle, a pair of links within the handle, means pivotably connecting the intermediate portion of each link to the handle, means connecting one end of the links together for relative movement therebetween, and means connecting the other end of each link to the grip bar for relative movement therebetween, respectively, the links being diposed opposite to the forward direction of movement of the grip bar, whereby any portion of the grip bar may be gripped, and whereby the grip bar will have a substantially parallel uniform forward movement relative to the handle, thereby facilitating a smooth release of the locking bolt.

2. The combination of claim 1, wherein the links are substantially equal in length, and wherein the triangle comprises an isoceles triangle, the base of which is formed by the grip bar, and the apex of which is formed by the said one ends of the links.

3. A door locking apparatus as claimed in claim 1, wherein the door locking bolt and the grip bar are interconnected through a cam and a cam follower.

4. A door locking apparatus as claimed in claim 3, wherein the door locking bolt and the grip bar are interconnected through the cam provided on the door locking bolt side and the cam follower provided on the grip bar side and being in pressure contact with the cam by a spring.

5. A door locking apparatus as claimed in claim 1, wherein the means connecting one end of the links together comprises a pin and a slot.

6. A door locking apparatus as claimed in claim 1, means connecting one end of the links together comprises segment gears which are meshed with each other.

7. A door locking apparatus as claimed in claim 1, wherein the means connecting the grip bar and the other end of each of the links comprises a pin and a slot.

8. A door locking apparatus as claimed in claim 1, wherein the means connecting the grip bar and the other end of each of the links comprises a rack a segment gear meshed with each other.

* * * * *